United States Patent [19]

Benedict

[11] 4,264,274

[45] Apr. 28, 1981

[54] APPARATUS MAINTAINING ROTOR AND STATOR CLEARANCE

[75] Inventor: Mark C. Benedict, Glastonbury, Conn.

[73] Assignee: United Technologies Corporation, Hartford, Conn.

[21] Appl. No.: 86,223

[22] Filed: Oct. 18, 1979

Related U.S. Application Data

[63] Continuation of Ser. No. 864,193, Dec. 27, 1977, abandoned.

[51] Int. Cl.[3] ..... F02C 7/20

[52] U.S. Cl. ..... 415/199.5; 415/218; 415/219 R

[58] Field of Search ..... 415/108, 115, 116, 134, 415/135, 136, 189, 190, 193, 199.5, 217, 218, 219 R; 60/39.16, 39.31, 39.32

[56] References Cited

U.S. PATENT DOCUMENTS

| | | | |
|---|---|---|---|
| 2,445,661 | 7/1948 | Constant et al. | 415/115 |
| 3,434,288 | 3/1969 | Petrie | 60/39.16 R |
| 3,754,883 | 8/1973 | Remberg | 415/219 R |

*Primary Examiner*—Louis J. Casaregola
*Attorney, Agent, or Firm*—Robert C. Walker

[57] ABSTRACT

A gas turbine engine has a rotor including a rotor shaft which is journaled within an external structural engine casing. Stator elements are mounted within the external casing about the rotor, and in order to maintain a precise radial clearance between the rotor and stator elements, a stator support assembly is positioned within the engine casing and supports the stator elements relative to the rotor. The support assembly is comprised by an internal casing having one portion that is free to move by a limited amount in radial directions relative to the external casing, and a casing support disc extending generally radially outward to the internal casing from a bearing on the rotor shaft. The casing support disc holds the internal casing radially fixed relative to the shaft and, thus, references the movable portion of the internal casing relative to the rotor and rotor shaft rather than the external engine casing.

14 Claims, 3 Drawing Figures

APPARATUS MAINTAINING ROTOR AND STATOR CLEARANCE

This is a continuation of U.S. Pat. application Ser. No. 864,193 (abandoned) filed on Dec. 27, 1977.

BACKGROUND OF THE INVENTION

The present invention relates to turbomachinery and is concerned more particularly with apparatus for controlling clearance between a rotor and stator elements in such machinery.

An inherent problem in gas turbine power plants is the maintenance of a close or tight running clearance between the rotating and non-rotating structures in compressor sections as well as turbine sections. The problem also exists in ducted turbofan engines between the fan elements and the shroud or duct surrounding the fan. A tight clearance is desired during all modes of engine operation in order to achieve and hold high performance with efficiency during an extended lifetime of the engine.

The problem, however, of maintaining a tight clearance originates from a number of sources. Manufacturing and assembly tolerances dictate that at least some running clearance be provided between the radially inner ends of the stator vanes and the radially outer ends of the rotor blades in a conventional axial flow engine. Other sources related to engine operation are equally or more significant than the manufacturing tolerances. Transient thermal growths of the stator and rotor components are not equal during all modes of engine operation and, therefore, adequate clearance must be provided to prevent destructive interference until a steady state condition is reached. Furthermore, in the steady state condition thermal expansion of both the rotor and stator components and inertial growth during changing power demands must be accommodated by the clearance. Still further, flight maneuver deflections of the rotor and casing add further to the difficulty of establishing a tight clearance between the rotating and non-rotating structures.

The clearance difficulties cannot be solved by simply maintaining a large space between the stator and rotor in the gas flow path because gas leakage past the vanes results in a loss of static pressure or gas velocity and reduces the power output of the engine with a corresponding increase in specific fuel consumption.

Accordingly, it is a general object of the present invention to provide an improved clearance control apparatus for maintaining a desired or preselected clearance between the rotating and non-rotating components in a turbomachine. It is a further object of the invention to provide apparatus within turbomachinery which, in addition to maintaining clearance control, also offers the opportunity of reducing rotor vibration.

SUMMARY OF THE INVENTION

The present invention resides in a turbomachine such as a gas turbine engine which contains a rotor and stator that operate in close running clearance. The rotor including a rotor shaft is mounted within the machine casing and may include a plurality of radially extending rotor blades that run in closely spaced relationship with non-rotating structure in order to operate efficiently. Such blades, for example, are found in both the compressor and turbine sections of a gas turbine engine. A plurality of stator vanes are also situated in closely spaced relationship with the rotor in such engines. Any relative movement of the rotor and stator affects the clearances of the blades and vanes and can result in destructive interference if not properly controlled.

In accordance with the present invention, a stator support assembly is positioned within the external casing of the turbomachine to support the stator elements. A first portion of the support assembly circumscribes the rotor and holds the stator elements around the rotor in closely spaced relationship. A second portion of the assembly extends between the first portion and the rotor shaft and holds the first portion radially fixed relative to the shaft for radial movement with the rotor relative to the external machine casing.

Accordingly, the stator support assembly associates the stator elements structurally with the rotor rather than the external casing, and motions of the rotor due to vibration, maneuver deflections and other forces are coupled to the stator elements to hold the clearance between the rotor and stator. Since there is no criticality associated with the clearance between the stator and machine casing, the machine casing can be spaced radially outward of the stator support assembly by an amount adequate to accommodate stator growth and rotor deflections.

DESCRIPTION OF THE PREFERRED EMBODIMENTS

Figure 1:
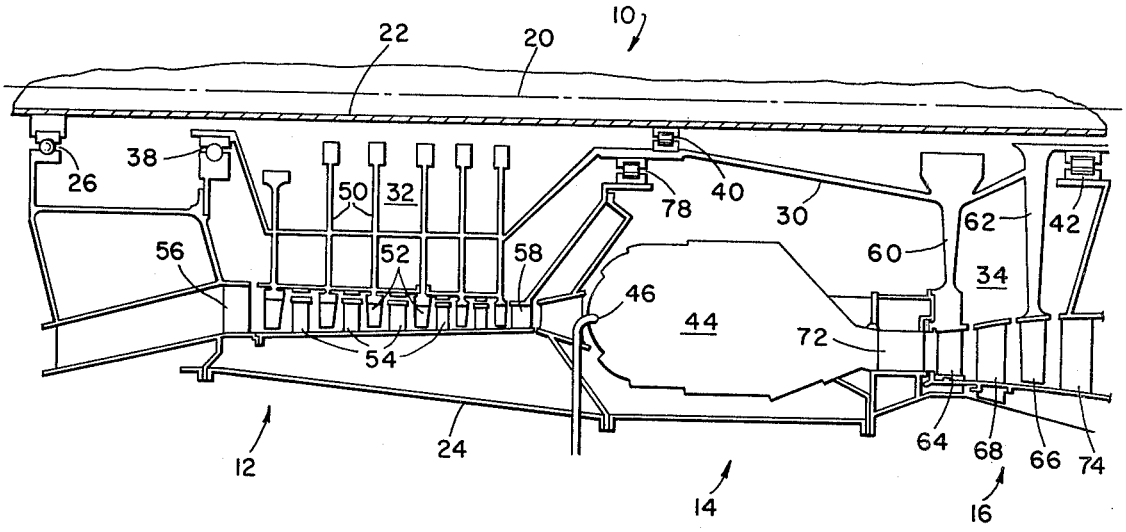
FIG. 1 is a longitudinal cross-section of an axial flow gas turbine engine employing the present invention.

FIG. 1 illustrates in simplified form a number of the principal components in an axial flow gas turbine engine generally designated at 10. The engine has a compressor section 12, a combustion section 14 and a turbine section 16 situated sequentially along the engine axis 20. Since the engine is generally annular in shape and has a construction which is generally symmetric about the engine axis 20, only the lower portion of the various engine sections are illustrated.

The engine 10 has a twin spool structure with an inner rotor shaft 22 connected at the forward end with a low pressure compressor (not shown) in the forward part of the compressor section 12 and connected at the aft end with a low pressure turbine (not shown) in the aft part of the turbine section 16. The inner rotor shaft 22 is journaled within the external engine casing 24 by means of a forward bearing 26 and an aft bearing (not shown).

The external casing 24 serves as the primary structural member for transmitting torque and thrust through the engine and to an associated engine mount in, for example, an aircraft. The remaining components in the engine are supported either directly or indirectly from the casing in order to transmit and react various stresses and loads developed during engine operation and in flight.

An irregularly shaped outer rotor shaft 30 is mounted coaxially about the inner shaft 22 and supports at its forward end the rotor of a high pressure compressor 32 and at its aft end the rotor of a high pressure turbine 34 which drives the compressor 32 through the shaft 30. At the forward end of the compressor 32 the rotor shaft 30 is journaled within the engine casing 24 by means of a bearing 38. At the mid portion of the engine, the shaft 30 is journaled on the inner rotor shaft 22 by means of an intermediate bearing 40 and to the rear of the turbine 34, the shaft is again journaled within the external engine casing 24 by means of a rear bearing 42.

In conventional operation of the axial flow engine 10, air or other working medium is ingested into the forward part of the engine and is pumped through the compressor section 12 to a plurality of burner cans 44 distributed circumaxially about the engine axis 20 in the combustion section 14. Fuel is injected into the burner cans through injectors 46 and combines with the air to form high velocity combustion gases that are discharged through the turbine 34 in order to drive the compressor 32 through the rotor shaft 30 and other components connected with the inner shaft 22.

The rotor of the compressor 32 is comprised of a plurality of rotor discs 50 arranged serially along the shaft 30, and each disc has a plurality of radially extending rotor blades arranged in an annular array about its periphery.

Positioned alternately between the annular arrays of rotor blades 52 are annular arrays of stator vanes 54 which guide the ingested air between successive stages of the compressor 32. Inlet guide vanes 56 are also positioned in an annular array in the air flow path at the inlet to the compressor 32 while exit guide vanes 58 are positioned in an annular array at the discharging end of the compressor. The stator vanes 54, the inlet guide vanes 56 and the exit guide vanes 58 are stator elements which must be accurately supported and held in non-rotating relationship within the engine 10. The stator vanes 54 project radially inward toward the compressor rotor and at their radially inner ends must be positioned with a small or tight running clearance relative to the rotor in order to prevent forward leakage of the air as it is progressively pumped to higher static pressure levels by the various stages of the compressor.

For the same reason, the radially outer tips of the rotor blades 52 must be accurately held and maintained in tight running relationship with the stator casing 80 defining the stationary outer wall of the air flow path through the compressor 32. Since higher pressure levels are developed as the air passes between alternate sets of stator vanes and rotor blades, the radial clearance of the vanes and blades at the last stage of the compressor, from which the air is discharged over the exit guide vanes 58, is more significant and critical than the radial clearance of the vanes and blades at the inlet of the compressor. The present invention in the form illustrated and described below addresses the clearance problem in direct proportion to its significance.

The rotor of the two stage turbine 34 is constructed somewhat similar to the rotor of the compressor 32 in that rotor discs 60 and 62 are connected with the shaft 30 and bear an annular series of radially projecting turbine blades 64 and 66 respectively at their peripheries. Positioned between the blades 64 and 66 is an annular series of stator vanes 68, and the stator vanes in conjunction with similarly arranged inlet guide vanes 70 and exit guide vanes 72 control the flow of hot combustion gases through the turbine section. In the illustrated turbine section, a small, tight running clearance is desired at the radially outer tips of the blades 64 and 66 to prevent the hot combustion gases from escaping past the blades with an attendant loss of power in the turbine section.

Figure 3:
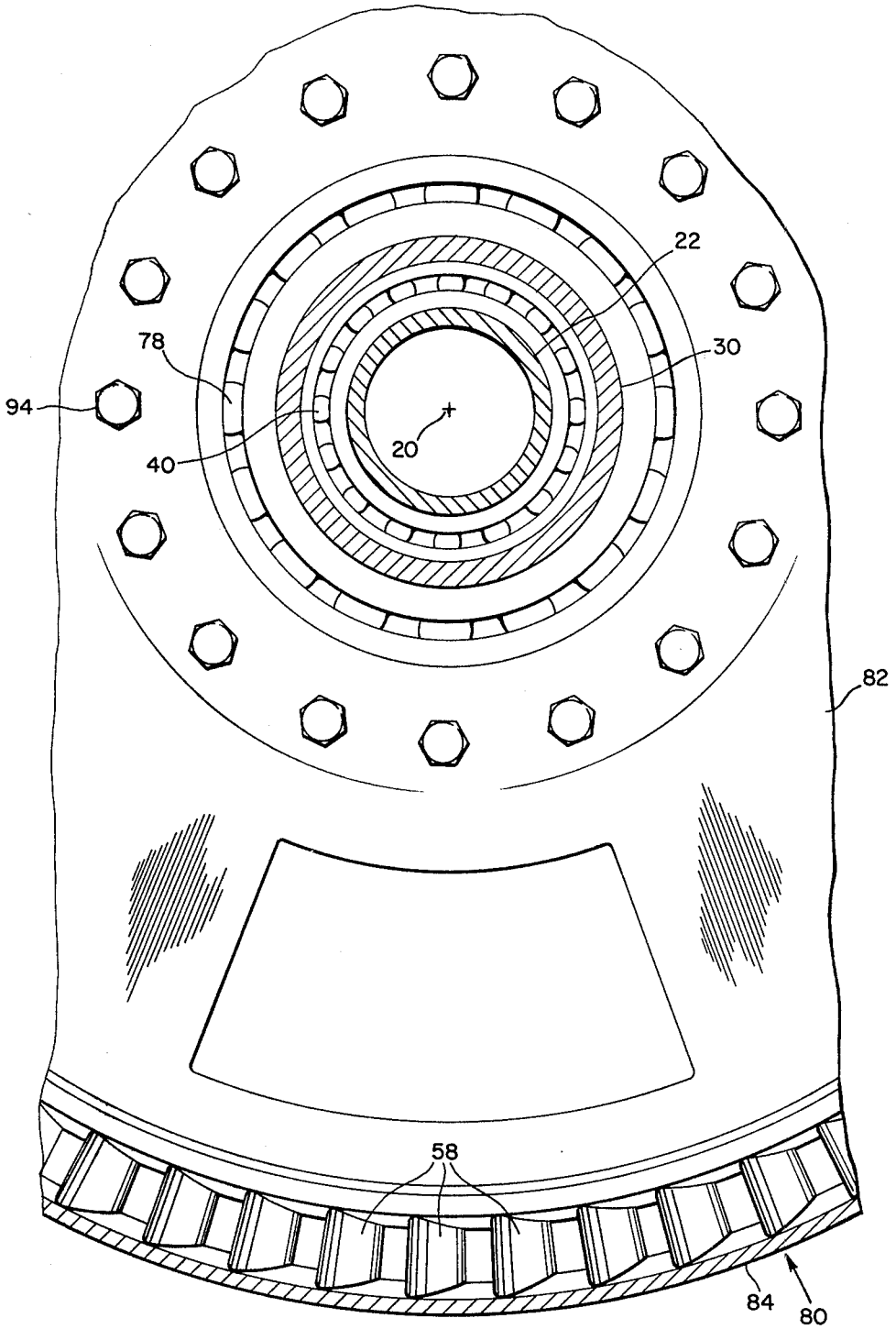
FIG. 3 is a fragmentary transverse sectional view of the engine as viewed along the sectioning line 3—3 in FIG. 2.

In accordance with the present invention the elements of the stator surrounding the compressor 32 are supported by an assembly including the internal stator casing 80 and a casing support disc 82 extending from the bearing 78 mounted on the rotor shaft 30 to the exit guide vanes 58 at the discharging end of the casing. The internal stator casing 80 is comprised of a plurality of annular shell sections 84 that are serially connected together over the compressor rotor. Each section 84 may be segmented, and a portion of the stator vanes 54 belonging to one particular stage of the compressor are mounted in the segment for transmission of vane loads to other parts of the engine. The support disc 82 is an apertured circular frame as shown in FIG. 3 and projects generally radially from the bearing 78 intermediate the shaft bearings 38 and 42 shown in FIG. 1. The support disc connects with the internal casing 80 at the aft axial end within the exit guide vanes 58.

The casing 80 and support disc 82 hold and thereby control the positioning of the stator vanes 54 in predetermined radial and axial relationship relative to the rotor. Also since the casing defines the outer periphery of the air flow path by means of its interior surfaces, the casing and disc 82 hold and control the clearance between the tips of the rotor blades and the stator structure.

Figure 2:
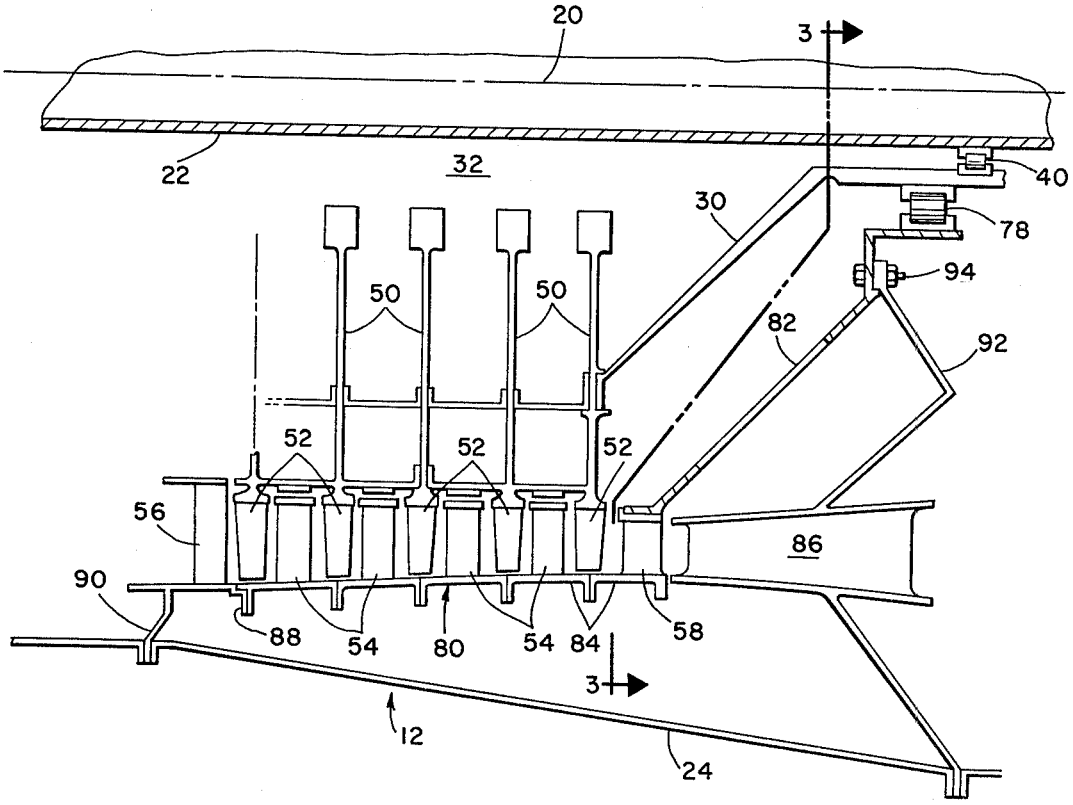
FIG. 2 is an enlarged fragmentary section of the engine in FIG. 1 and shows one embodiment of the invention in detail.

It will be observed in FIG. 2 that the annular diffuser 86, through which the compressed air passes to the combustion chambers 44 (FIG. 1), is supported directly from the external structural casing 24 but is isolated from the internal casing 80 at their junction. Thus, the trailing portion of the internal casing 80 is effectively isolated from stress and strain transmitted in the external casing. The forward portion of the internal casing 80 is piloted and thereby sealed within a stepped joint formed in a flange 88 around the inlet guide vanes 56. The front of the guide vanes 56 includes an additional flange 90 that connects directly to the external casing 24 so that the internal casing at the front is effectively in abutting relationship with the external casing.

When mounted in this fashion, the trailing portion of the internal casing 80 is free to move or flex radially by a limited amount relative to the outwardly spaced external casing 24. Such freedom of movement is important in controlling clearances at the tips of the rotor blades 52 and the stator vanes 54 in the last stage or stages of the compressor 32. Stress and strain carried through the external casing 24 cannot be transmitted directly to the rear portion of the internal casing 80 due to the isolation of the diffuser 86 from the casing. Furthermore, the support disc 82 which extends radially outward from the bearing 78 is the structural element establishing the position of the internal casing at the rear relative to the rotor blades 52. Although the external casing 24 is connected to the support disc 82 through the diffuser 86 and a box frame member 92, the coupling formed by bolts 94 between the member 92 and the disc 82 is made substantially at the bearing 78, and the frame member 92 is shaped or bent in a manner which is not conducive to transmitting radial loads or deflections of the external casing 24 to the disc 82. The frame member 92, however, is capable of carrying a torque so that torque loads developed by the stator vanes 54 may be transmitted to the external casing through the internal casing 80 and the support disc 82.

The forward end of the internal casing 80 is piloted in the flange 88 by means of the stepped joint which restricts radial movement of the casing 80 at its forward portion. The joint also permits thrust loads developed by the stator vanes 54 to be transmitted directly to the external casing 24. The restricted radial movement of the casing at its forward portion is not so critical insofar as vane and blade clearances are concerned because the first few compressor stages beyond the inlet guide vanes 56 are working with air at a lower pressure. Consequently, pressure and leakage are of lower magnitude.

In contrast, the last stage of the compressor operates with air at a substantially higher pressure and requires a much finer control over the blade and vane clearances. The external casing is intentionally isolated from the internal casing 80 at the read and loads carried through the external casing cannot affect the rotor/stator clearance at this point. At the same time, the aft portion of the internal casing is supported directly from the rotor shaft 30 so that any radial movement or vibration of the shaft that would affect rotor clearance is coupled directly to the casing for corresponding radial displacement.

Accordingly, the degree of control exercised by the disclosed stator support assembly is generally proportional to the criticality of the prescribed clearance.

While the present invention has been described in a preferred embodiment, it should be understood that numerous modifications and substitutions can be had without departing from the spirit of the invention. For example, the box frame member 92 need not be connected with the casing support disc 82 as shown in the drawings. In such instance a torque developed by the stator blades 54 can be taken out through the diffuser 86 by means of other couplings which maintain radial isolation between the internal casing 80 and the diffuser. Alternately, a torque transmitting connection may be provided between the flange 88 and the front portion of the casing 80. Although the forward portion of the casing is shown connected with the outer casing through the flanges 88 and 90, it is contemplated that complete isolation of at least one shell section of the internal casing 26 can be had by mounting that section solely from the support disc 82 in axially spaced relation from the remaining sections. For example, the shell sections enveloping the last stage or stages of the compressor may be isolated from the outer shell sections without additional support for those sections connected with the disc 82. In this instance, total isolation from the external casing is provided at the critical stages of the compressor. Isolation of the internal and external casing also permits vibration of the rotor to be damped. For example, viscous dampers can be employed between the inner and outer casings near the support disc 82 to dissipate or control midrotor vibration that occurs between the journal bearings 38 and 42. The two casings being supported in spaced relationship radially of each other also afford structure for ducting secondary air through the compressor to control thermal response of the internal case and stator vanes which may further reduce running clearances. The axial separation between vanes and blades may also be altered in the illustrated structure by appropriate selection of the thrust reaction points. Lastly, the invention is not limited in its application to the high pressure compressor but may be used with equal facility in fan structures, low pressure compressors and high and low pressure turbines as well. Accordingly, the present invention has been described in a preferred embodiment by way of illustration rather than limitation.

I claim:

1. In a gas turbine engine having a rotor including a rotor shaft journaled within an external engine casing and a rotor disc mounted on the shaft and having a plurality of radially extending blades disposed in annular array for rotation in the engine relative to a stator having a plurality of non-rotating vanes in an annular array adjacent the blades, an improved clearance control apparatus for the rotor and stator comprising: an internal vane mount supporting the non-rotating vanes in annular array about the rotor in inwardly spaced relationship from the external engine casing and with at least limited freedom of radial movement relative to the engine casing; and an internal support journaled on the rotor shaft and extending generally radially outward from the shaft and connecting with the radially inner ends of the non-rotating vanes for holding the array of vanes radially from the rotor without relative movement between the inner ends of the vanes and the internal support and for radial movement relative to the external engine casing.

2. In a gas turbine engine, the improved clearance control apparatus of claim 1 wherein the internal mount comprises an inner casing mounted in radially spaced relationship within the external casing and defining the outer periphery of the gas flow path over the rotor blades.

3. In a gas turbine engine, the improved clearance control apparatus of claim 2 wherein the inner casing extends coaxially of the rotor shaft and envelopes multiple stages of rotor blades and non-rotating vanes between opposite axial ends of the inner casing; and the internal support journaled on the shaft extends from the shaft to the non-rotating vanes in annular array adjacent one of the opposite axial ends of the inner casing.

4. In a gas turbine engine, the improved clearance control apparatus of claim 3 wherein the other axial end of the inner casing remote from the end having the non-rotating vanes connected to the internal support is supported from the external casing.

5. In a gas turbine engine, the improved clearance control apparatus of claim 1 wherein the rotor shaft is rotatably mounted in the external casing by means of journal bearings at axially separated stations along the shaft; and the internal support extends radially outward to the non-rotating vanes from a position along the rotor shaft intermediate the journal bearings.

6. In a gas turbine engine, the improved clearance control apparatus of claim 1 further including means connected between the external engine casing the internal vane mount for transmitting axially directed thrust from the non-rotating vanes to the external casing through the internal mount.

7. In a gas turbine engine, the improved clearance control apparatus of claim 6 wherein the internal vane mount is an internal engine casing supporting the annular array of vanes, and the thrust-transmitting means is comprised by axially abutting members between the internal and external engine casings.

8. Apparatus for maintaining a prescribed clearance between the rotor and stator of a turbomachine having a rotor shaft rotatably mounted in the machine casing comprising: a stator support assembly positioned within the machine casing coaxially of the rotor shaft and having multiple stages of stator vanes supported serially along the assembly from one axial end to the other, the one axial end of the assembly being radially detached from the machine casing and free to move radially relative to the casing, and including a shaft support extending generally radially between the rotor shaft and the radially inner ends of the vanes in the stage adjacent the detached axial end of the support assembly and fixedly attached to said radially inner ends of the vanes without provision for radial movement of the inner ends relative to the attached support and for maintenance of a prescribed clearance with the rotor.

9. Apparatus for maintaining a prescribed clearance between a rotor and a stator as defined in claim 8 wherein the stator support assembly comprises an inner casing circumscribing the rotor and supporting the multiple stages of stator vanes.

10. Apparatus for maintaining a prescribed clearance between a rotor and stator as defined in claim 8 wherein the stator support assembly comprises an annular stator casing extending axially over the rotor, the one axial end of the casing being connected to the shaft support through the stage of vanes adjacent said one axial end and the other axial end of the casing being connected with the machine casing.

11. Apparatus for maintaining a prescribed clearance between a rotor and stator as described in claim 8 wherein a bearing is mounted on the rotor shaft, and the shaft support of the support assembly is connected with the rotor shaft by means of the bearing.

12. Apparatus for maintaining a prescribed clearance as defined in claim 11 wherein the rotor shaft is rotatably mounted in the machine casing at two axially spaced stations along the shaft and the bearing connected with the shaft support of the stator support assembly is mounted on the shaft at another station intermediate the two axially spaced stations.

13. Apparatus for maintaining a prescribed clearance as defined in claim 10 wherein the axial end of the stator casing connected with the machine casing is connected in thrust-transmitting relationship.

14. Apparatus for maintaining a prescribed clearance between the rotor and stator of a turbomachine having a rotor shaft rotatably mounted in the machine casing comprising:

a stator support assembly positioned within the machine casing coaxially of the rotor shaft and having multiple stages of stator vanes supported serially along the assembly from one axial end to the other, the one axial end of the assembly being radially detached from the machine casing and free to move radially relative to the casing, and including a shaft support extending generally radially between the rotor shaft and the radially inner ends of the vanes in the stage adjacent the detached axial end of the support assembly and holding the detached end radially relative to the shaft for radial movement with the rotor relative to the machine casing, the support being comprised by a torque-transmitting disc for transmitting torque developed in the stator; and torque-transmitting means connected between the disc near the rotor shaft and the machine casing.

* * * * *

UNITED STATES PATENT AND TRADEMARK OFFICE

CERTIFICATE OF CORRECTION

PATENT NO. : 4,264,274

DATED : April 28, 1981

INVENTOR(S) : Mark C. Benedict

It is certified that error appears in the above—identified patent and that said Letters Patent is hereby corrected as shown below:

Col. 5, line 16 "read" should be -- rear --

Col. 5, line 47 "outer" should be -- other --

Signed and Sealed this

*Eighteenth* Day of *August 1981*

[SEAL]

*Attest:*

GERALD J. MOSSINGHOFF

*Attesting Officer*

*Commissioner of Patents and Trademarks*